United States Patent [19]

Martini et al.

[11] Patent Number: 5,006,129

[45] Date of Patent: Apr. 9, 1991

[54] DYEING TEXTILE MATERIAL WITH PIGMENT DYES: PRE-TREATMENT WITH QUATERNARY ALLY AMMONIUM SALT POLYMER

[75] Inventors: Thomas Martini, Kelkheim; Karl-Heinz Keil, Hanau; Ulrich Karsunky, Hünfelden; Klaus Sternberger, Bad Vilbel, all of Fed. Rep. of Germany

[73] Assignee: Hoechst Aktiengesellschaft, Franktfurt am Main, Fed. Rep. of Germany

[21] Appl. No.: 459,270

[22] Filed: Dec. 29, 1989

[30] Foreign Application Priority Data

Dec. 29, 1988 [DE] Fed. Rep. of Germany ..... 3844194

[51] Int. Cl.[5] ..... D06P 1/44; D06M 5/04; D06M 15/35

[52] U.S. Cl. ..... 8/554; 8/529; 8/918

[58] Field of Search ..... 8/554

[56] References Cited

U.S. PATENT DOCUMENTS 4,810,254 3/1989 Bauer et al. ..... 8/554

FOREIGN PATENT DOCUMENTS 322080 6/1989 European Pat. Off. .

OTHER PUBLICATIONS

Venkataraman's "The Chemistry of Synthetic Dyes", vol. V, (Academic Press), 1971, p. 314.

H. Zollinger, "Color Chemistry" (VCH), 1987, pp. 1 and 238 and 242–243.

*Primary Examiner*—A. Lionel Clingman

[57] ABSTRACT

Process for dyeing textile material with pigment dyes, which comprises 1. pretreating the textile material with a polymer which consists wholly or partly of monomeric units of the formula I

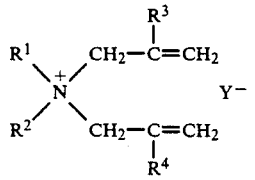

(I)

where $R^1$ and $R^2$ are each hydrogen, $(C_1-C_{22})$alkyl which may be interrupted by —CO—NH— or —N-H—CO—, or $C_1-C_4$-hydroxyalkyl, $R^3$ and $R^4$ are each hydrogen or methyl, and $Y^-$ is a monovalent anion or one equivalent of a polyvalent anion, 2. then dyeing with a pigment dye in the presence of a leveling or dispersing agent by the exhaust method and if necessary
3. treating the dyeing in a liquor with a pigment binder and subsequently fixing it.

This process makes it possible to dye textile material, in particular ready-made jeans garments, with pigment dyes by an exhaust method.

14 Claims, No Drawings

DYEING TEXTILE MATERIAL WITH PIGMENT DYES: PRE-TREATMENT WITH QUATERNARY ALLY AMMONIUM SALT POLYMER

It is known to dye textile material with pigment dyes in a continuous manner by padding. The reason why the use of pigment dyes is popular is that they have excellent light fastness properties and show good stability to dry-cleaning. Since pigments are water-insoluble, they must be attached to the fiber with the aid of suitable binders. The disadvantage with padding is the fact that with time there is a buildup of binder on the rolls of the machine units. This can lead to creasing of the cloth and hence to stripey and unlevel dyeings. The dyeing machine must then be stopped and laboriously cleaned before it can be restarted. Furthermore, considerable yardages are required for continuous processing and hence padding to be viable. This process is consequently not very flexible. Ready-made garments cannot be dyed by the padding technique.

It is an object of the present invention to dye textile material with pigment dyes not by padding but by an exhaust method. This object is achieved by pre-treating the textile material with a cationic assistant and then dyeing it with a pigment dye by an exhaust method.

The present invention accordingly provides a process for dyeing textile material with pigment dyes, which comprises 1. pretreating the textile material with a polymer which consists wholly or partly of monomeric units of the formula I

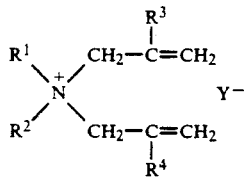

(I)

where $R^1$ and $R^2$ are each hydrogen, $(C_1-C_{22})$alkyl which may be interrupted by —CO—NH— or —N-H—CO—, or $C_1-C_4$-hydroxyalkyl; hydroxyalkyl, $R^3$ and $R^4$ are each hydrogen or methyl, and $Y^-$ is a monovalent anion or one equivalent of a polyvalent anion, 2. then dying with a pigment dye in the presence of a leveling or dispersing agent by the exhaust method and if necessary 3. treating the dyeing in a liquor with a pigment binder and subsequently fixing it.

The process according to the invention is suitable for all natural or synthetic fibers, e.g. cotton, wool, silk, polyester, polyamide or viscose, and for blends of various fibers. The textile material can be in various stages of processing, for example fiber, filament, yarn, slubbing, woven fabric, hosiery or knitwear. Preferably, the process according to the invention is suitable for dyeing ready-made garments made of cotton, in particular jeans goods.

If cotton is to be dyed, it is preferably first pre-treated with a wetting agent. Suitable for this purpose are conventional anionic or nonionic wetting agents in amounts of about 2 to 4% by weight, on weight of fiber. The pretreatment is carried out at about 20°-80° C. for 5-20 minutes. The specific process parameters depend on the fabric weighed and on the desired effect. Instead of a separate pretreatment it is also possible to add nonionic wetting agents to the liquor containing the cationic pretreatment agent.

The textile material to be dyed which, in the case of cotton, is the material which has been treated with a wetting agent, as mentioned above, is pretreated by the exhaust method with a cationic polymer of the above-specified composition.

In this polymer, the radicals $R^1$ and $R^2$ on the one hand and $R^3$ and $R^4$ on the other can be identical to or different from each other. The radicals $R^1$, $R^2$, $R^3$ and $R^4$ can also all be the same and denote hydrogen or methyl. Alkyl and hydroxyalkyl $R^1$ and $R^2$ can be straight-chain or branched. Preferably, $R^1$ and $R^2$ each represent uninterrupted alkyl radicals of 1 to 10 carbon atoms, very particularly preferably uninterrupted alkyl radicals of 1 to 4 carbon atoms.

Examples of suitable alkyls $R^1$ and/or $R^2$ are: n-docosyl, n-pentadecyl, n-decyl, i-octyl, i-heptyl, n-hexyl, i-pentyl, preferably n-butyl, i-butyl, sec-butyl, i-propyl, n-propyl, ethyl and methyl.

The radicals $R^1$ and $R^2$ are preferably identical, the preferred meaning for both being methyl.

Preferably, $R^3$ and $R^4$ are likewise identical, in which case the preferred meaning for both is hydrogen.

A monovalent anion $Y^-$ can be nitrate, hydrogensulfate, benzenesulfonate, fluoride, chloride, bromide, iodide, acetate, propionate or any other radical of a carboxylic acid. One equivalent of polyvalent anion can be for example ½ an equivalent of sulfate or ⅓ an equivalent of phosphate. Preferably $Y^-$ is a halogen anion, such as bromide or iodide, but in particular chloride.

The compounds of the formula I are known, as are the polymers derived therefrom (cf. for example Ottenbrite and Ryan, Cyclopolymerization of N,N-Dialkyldiallylammonium Halides, Ind. Eng, Chem. Prod. Res. Dev. Vol. 19, No. 4, (1980), 528-532). It must be assumed that the homo- and copolymerization of compounds of the formula I chiefly give rise in the polymer to 5- or 6-membered cyclic repeat units of the formulae II and III

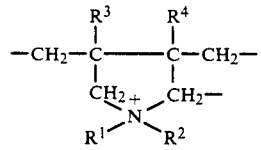

(II)

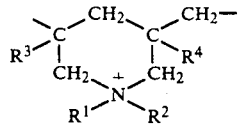

(III)

In copolymers, the repeat units formed from the compound I may also have other structurs, depending on the comonomers used. For example, repeat units of the formulae IV, V and VI can form on using sulfur dioxide in a polymerization as well as compounds of the formula I.

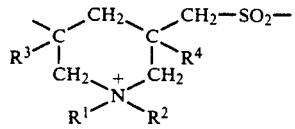

(IV)

-continued

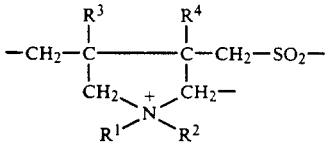

(V)

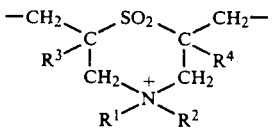

(VI)

In the repeat units depicted in the formulae II to VI, the corresponding anion $Y^-$ has been omitted in each case.

The polymer used contains up to 100 mol %, in particular 15 to 100 mol %, preferably 40 to 100 mol %, very particularly preferably 80 to 100 mol %, of a compound of the formula I in copolymerized form.

A polymer which contains 100 mol % of the compound of the formula I in copolymerized form is prepared by polymerizing one or more compounds of the formula I in a conventional manner. To prepare polymers which contain less than 100 mol % of a compound of the formula I in copolymerized form, one or more compounds of the formula I are copolymerized together with sulfur dioxide and/or with one or more other comonomers in a conventional manner while maintaining appropriate molar ratios. Suitable comonomers for such a copolymerization are for example acrylamide, methacrylamide, N,N-dimethylaminopropylacrylamide,
N,N-diethylaminopropylacrylamide,
N,N-dimethylaminopropylmethacrylamide,
N,N-diethylaminopropylmethacrylamide,
N,N-dimethylaminobutylacrylamide,
N,N-diethylaminobutylacrylamide,
N,N-dimethylaminobutylmethacrylamide, and
N,N-diethylaminobutylmethacrylamide.

Particularly preferred comonomers for preparing the polymers used in the process according to the invention are basic compounds of the general formula VII

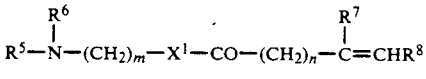

(VII)

and/or amides of the general formula VIII

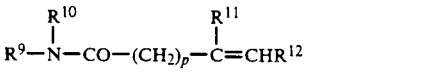

(VIII)

and/or N-vinylacylamides of the general formula IX

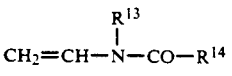

(IX)

and/or ammonium compounds of the general formula X

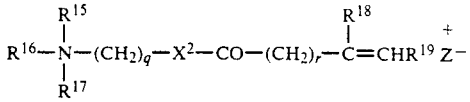

(X)

and/or acrylic or methacrylic esters of the general formula XI

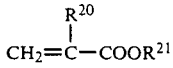

(XI)

where $R^5$, $R^6$, $R^{21}$ = $(C_1-C_{10})$alkyl,
$R^7$, $R^8$, $R^{11}$, $R^{12}$, $R^{18}$, $R^{19}$, $R^{20}$ = hydrogen or methyl,
$R^9$, $R^{10}$, $R^{13}$ = hydrogen or $(C_1-C_8)$alkyl,
$R^{14}$, $R^{15}$, $R^{16}$, $R^{17}$ = $(C_1-C_8)$alkyl or
$R^{13}$ and $R^{14}$ together = $-(CH_2)_3-$, $-(CH_2)_4-$ or $-(CH_2)_5-$,
$X^1$, $X^2$ = —NH— or —O—,
$Z^-$ is a monovalent anion or one equivalent of a polyvalent anion,
m and q are one of the numbers 2, 3, 4, 5, 6, 7, 8, 9, 10, and n, p and r are one of the numbers 0, 1, 2 or 3.

All the alkyl radicals in the foregoing formulae VII to XI can be straight-chain or branched, and preferably have 1 to 4 carbon atoms. $Z^-$ can have one of the meanings indicated for $Y^{31}$ and preferably is identical to $Y^-$.

$X^1$ and $X^2$ are preferably each —NH—.

Preference is given to using in the process according to the invention a polymer which is preparable by polymerizing (a) a diallylammonium component a of the formula I and
(b) an amide component B comprising a basic component $B^1$ of the formula VII and/or an amide component $B^2$ of the formula VIII and/or an N-vinylacylamide component $B^3$ of the formula IX and/or an ammonium component $B^4$ of the formula X and
(c) a (meth)acrylic ester component C of the formula XI in a molar ratio of A:B:C = 1:(0 to 4.5):(0 to 0.5), preferably in a molar ratio A:B:C = 1:(0.002 to 4.5):(0 to 0.5).

The water-soluble polymers used in the process according to the invention can also have been crosslinked. To prepare such water-soluble crosslinked polymers it is advantageous to crosslink a copolymer of a component $B^1$ of the formula VII, after the copolymerization, by reacting it with (d) a polyfunctional alkylation component D and
(e) a polyamine component E which consists of a polyamine component $E^1$ of the formula XII

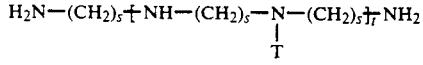

(XII)

and/or a polyamine component $E^2$ of the formula XIII

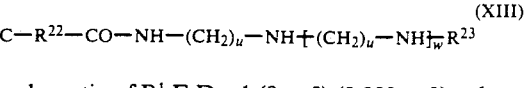

(XIII)

in a molar ratio of $B^1$:E:D = 1:(0 to 5):(0.002 to 2), where $R^{22}$ is alkylene of 1 to 8 carbon atoms or phenylene,
$R^{23}$ is hydrogen or the radical —CO—$R^{22}$—COOH
T=[—$(CH_2)_s$—NH—]$_v$—H
W=one of the numbers 0, 1, 2 or 3,
s, u=one of the numbers 2, 3, 4 or 5,
v=the number 0 or such a number that polyamine component $E^1$, if t is taken into account, has a molecular weight of 1000 to 30,000, and
t=such a number that, if v is taken into account, the molecular weight of polyamine component $E^1$ of the formula XII is between 1000 and 30,000.

In the preparation of polymers of preferred use in the process according to the invention, the diallylammonium component A can consist of one compound of the formula I or else of more than one compound of the formula I. Similarly, the other components B, $B^1$, $B^2$, $B^3$, $B^4$, C, D, $E^1$ and $E^2$ can each consist of one or more than one compound. The amide component B can consist of an amide component $B^1$or of an amide component $B^2$ or of an N-vinylacylamide component $B^3$ or of an ammonium component $B^4$. However, the amide component B can also consist of for example two individual components (e.g. $B^1+B^2$, $B^1+B^3$, $B^2+B^3$ or $B^3+B^4$) or for example of three individual components (e.g. $B^1+B^2+B^3$or $B^1+B^3+B^4$). However, the amide component B can also contain all four individual components ($B^1+B^2+B^3+B^4$). In all the cases mentioned, the individual components $B^1$, $B^2$, $B^3$ and $B^4$ may in turn consist of one or more individual compounds of the stated formulae.

In the formula VII for the basic component $B^1$, X is preferably —NH—, n is preferably 0, and m is preferably 2, 3 or 4. $R^5$ and $R^6$ can be identical or different and each is preferably ($C_1$-$C_4$)alkyl. $R^7$ and $R^8$ may likewise be identical or different. Examples of particularly preferred compounds of the formula VII are:

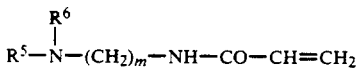
(VIIa)

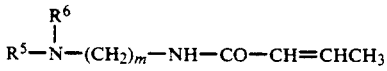
(VIIb)

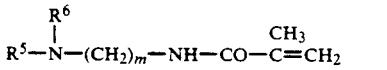
(VIIc)

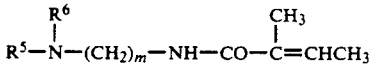
(VIId)

where, in the formulae VIIa to VIId, $R^5$, $R^6$ and m have in particular the preferred meanings.

In the formula VIII for the amide components $B^2$, b is prefereably 0, and $R^9$ and $R^{10}$ on the one hand and $R^{11}$ and $R^{12}$ on the other can be identical or different. $R^9$ and $R^{10}$ are each preferably hydrogen or ($D_1$-$C_4$)alkyl. Similarly, $R^{11}$ and $R^{12}$ can be identical or different. Example of particularly preferred compounds of the formula VIII are:

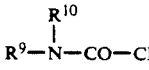
(VIIIa)

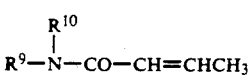
(VIIIb)

-continued

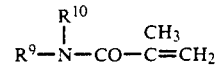
(VIIIc)

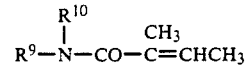
(VIIId)

where, in the formulae VIIIa to VIIId, $R^9$ and $R^{10}$ have in particular the preferred meanings.

In the formula IX for the N-vinylacylamide component $B^3$, $R^{14}$ is preferably ($C_1$-$C_4$)alkyl. $R^{13}$ is preferably hydrogen or ($C_1$-$C_4$)alkyl. $R^{13}$ and $R^{14}$ may also be preferably together —$(CH_2)_3$—, —$(CH_2)_4$)— or —$(CH_2)_5$—. Examples of preferred compounds of the formula IX are N-vinyl-2-pyrrolidone, N-vinyl-2-piperidinone and N-vinyl-ε-caprolactam.

In the formula X for the ammonium component $B^4$, $X^2$ is preferably —NH—. $R^{15}$, $R^{16}$ and $R^{17}$ can be identical or different and each is preferably ($C_1$-$C_4$)alkyl, very particularly preferably methyl, r is preferably 0, and q is preferably 2, 3 or 4.

In the formula XI for the (meth)acrylic ester component C, $R^{21}$ is in general ($C_1$-$C_8$)alkyl, preferably ($C_1$-$C_4$)alkyl. In the case of $R^{20}$=hydrogen, the compounds of the formula VI are acrylic esters, while in the case of $R^{20}$=methyl they are methacrylic esters.

The polyfunctional alkylation component B has for example the formula XIV

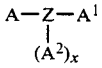
(XIV)

where x is 0, 1, 2 or 3, preferably 0, and A, $A^1$ and $A^2$ are identical or different radicals of the formula —$CH_2A^3$ or an epoxide radical (oxirane radical) of the formula XVI or XVII

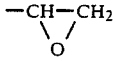
(XVI)

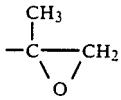
(XVII)

$A^3$ is a detachable anion substituent, in particular chloride, bromide or iodide, or a detachable anion group, such as, for example hydroxyl, a sulfato radical or phosphato radical, and Z is a direct bond or an (x+2)valent organic radical. Z can be an aliphatic, aromatic or araliphatic radical, of which the aliphatic and araliphatic radical may also contain keto groups —CO— or hetero atoms such as —O— or —S—, or heteroatom groupings, such as —SO—, —$SO_2$—, —NH—, —N($CH_3$)—. Z, in conformity with the preferred meaning of x=0, is preferably a divalent radical, so that the polyfunctional alkylation component D is preferably a bifunctional alkylation component. Particularly preferred bifunctional alkylating agents conform to the formula XVIII $$A—Z^1—A^1 \qquad (XVIII)$$

where Z is a direct bond, a phenylene radical, in particular a 1,4-phenylene radical, or a radical of the formula —$(CH_2)_y$— or —$(CH_2)_k$—G—$(CH_2)_l$—, wherein y is a number from 1 to 6, k and l are each from 1 to 6 and G is —O—, —S—, —SO—, —$SO_2$—, —NH—, —N($CH_3$)—, —CO—, —CHOH— or phenylene, in particular 1,4-phenylene. Preferably, k and l are identical, and each preferably denotes 1 or 2, in particular 1.

Examples of preferred bifunctional alkylating agents of the formula XVII are epichlorohydrin (=chloromethyloxirane), epibromohydrin, 1,3-dichloro-2-propanol, 2,2'-dichlorodiethyl ether, 2,2'-dichlorodiethylamine, 2,2'-dichlorodiethyl sulfide, 2,2'-dichlorodiethyl sulfoxide, 2,2'-dichlorodiethyl sulfone, 2,2'-bis(sulfato)ethyl ether, 2,2'-bis(phenylsulfonyloxy)ethyl ether, 2,2'-bis(p-tolylsulfonyloxy)ethyl ether, diepoxybutane, diepoxy-2-methylbutane, bisglycidylamine (=bis(2,3-epoxypropyl)amine), 1,2- or 1,4-bis(epoxyethyl)benzene, 1,2- or 1,4-bis(2,3-epoxypropyl)benzene and 1,2- or 1,4-bis(chloromethyl)benzene.

The polyamide component E can consist of one component $E^1$ or $E^2$ or of the two components $E^1$ and $E^2$.

In the formula XII of the polyamine component $E^1$, s is preferably 2. In this case, preferred representatives of polyamine component $E^1$ of the formula XII are commercial polyethyleneimines having a molecular weight between 2000 and 27,000, preferably between 2000 and 20,000, particularly preferably between 2000 and 5000. Such polyethyleneimines are commercially available. They are prepared by polymerizing ethyleneimine and contain about 50 to 600 ethyleneimine units and customarily primary, secondary and tertiary nitrogen atoms in a numerical ratio of about 1:2:1. The various nitrogen atoms are randomly distributed in the molecule. In the process for preparing the crosslinked copolymers they are preferably used directly in the form of their commercial aqueous solutions.

In the polyamide component $E^2$ of the formula XIII, the alkylene radical $R^{22}$ can be branched or preferably straight-chain. A phenylene $R^{22}$ is preferably 1,4- or 1,2-phenylene. The compounds of the formula XIII are reaction products of amines of the formula XIX $$H_2N—(CH_2)_u—NH—[—(CH_2)_u—NH—]_w—H \quad (XIX)$$

with dicarboxylic acids of the formula XX $$HOOC—R^{22}—COOH \quad (XX)$$

in [illegible] ratio of 1:(0.5 to 1). u is preferably 2 or 3, and w [illegible]rably 1, 2 or 3. Preferred amines of the form[illegible] are for example:

[illegible]—$CH_2$—$CH_2$—NH—$CH_2$—$CH_2$—$NH_2$,
[illegible]—$CH_2$—$CH_2$—$CH_2$—NH—$CH_2$—$CH_2$—$CH_2$—$NH_2$,
$H_2N$—$CH_2$—$CH_2$—NH—$CH_2$—$CH_2$—NH—$CH_2$—$CH_2$—$CH_2$—$NH_2$,
$H_2N$—$CH_2$—$CH_2$—NH—$CH_2$—$CH_2$—NH—$CH_2$—$CH_2$—NH—$CH_2$—$CH_2$—$NH_2$.

Suitable dicarboxylic acids of the formula XX are for example oxalic acid, malonic acid, succinic acid, glutaric acid, adipic acid, pimelic acid, suberic acid, azelaic acid, sebacic acid, phthalic acid and isophthalic acid.

In a preferred copolymer, the molar ratio of A:B:C is 1:(0.02 to 2.5):0. In a preferred crosslinked copolymer, the molar ratio of $B^1$:E:D is 1:(0.05 to 10):(0.002 to 1), preferably 1:(0.1 to 5):(0.01 to 1).

The starting components required for preparing the polymers and copolymers are known or can be prepared by methods known for the particular class of substances.

The preparation of the water-soluble polymers and copolymers used according to the invention by polymerization or copolymerization, in particular by homopolymerization of the diallyl component A or copolymerization of the diallyl component A, the amide component B and the (meth)acrylic ester component C takes place in a suitable solvent. A suitable solvent is water mixed with a water-miscible solvent. Suitable water-miscible solvents are for example lower alcohols, e.g. methanol, ethanol, n-propanol, i-propanol, n-butanol, tert-butanol, glycols and diols, e.g. ethylene glycol, propylene glycol, 1,3-propanediol, 1,2-propanediol, di- and polyglycols, e.g. ethylene glycol monomethyl ether, diethylene glycol monoethyl ether, ethylene glycol monomethyl ether, ethylene glycol monoethyl ether, ethylene glycol mono-n-propyl ether, ethylene glycol mono-n-butyl ether, ethylene glycol dimethyl ether, ethylene glycol diethyl ether, and ketones, e.g. acetone or methyl ethyl ketone. Alcohols of 1 to 4 carbon atoms are preferred.

The homo- or copolymerization can also be carried out in a mixture of various solvents, preferably in a solvent mixture which contains small amounts of water. If for example the diallylammonium component A is used in the form of an aqueous solution, further water need normally not be added.

Preference is given to water mixed with alcohols, in particular those of 1 to 4 carbon atoms, or mixed with diols and glycols.

Before the start of the homo- or copolymerization it is advantageous to set pH 3–8.5. This pH is in general set with an acid, preferably an organic acid, in particular acetic acid.

The homo- or copolymerization is carried out at temperatures of 40° to 100° C. preferably 60° to 90° C., very particularly preferably at temperatures of 65° to 85° C., and is started in a conventional manner, for example by the addition of a suitable initiator. Suitable initiators are substances which form free radicals, e.g. benzoyl peroxide, tert-butyl hydroperoxide, cumene peroxide, methyl ethyl ketone peroxide, lauroyl peroxide, tert-butyl perbenzoate, di-tert-butyl perphthalate, azodiisobutyronitrile, 2,2'-azobis(2,4-dimethylvaleronitrile), 2-phenylazo-2,4-dimethyl-4-methoxyvaleronitrile, 2-cyano-2-propylazoformamide, azodiisobutylamide, dimethyl, diethyl or di-n-butyl azobismethylvalerate, tert-butyl perneodecanoate, diisononanoyl peroxide, tert-amyl perpivalate, di-2-ethylhexyl peroxydicarbonate, dilauroyl peroxide, diisotridecyl peroxydicarbonate, tert-butyl peroxyisopropylpercarbonate. The preferred initiator is 2,2'-azobis(2-amidinopropane) dihydrochloride, 2,2'-azobis(2-imidazol-2-ylpropane) dihydrochloride, 2,2'-azobis(2-carbamoylpropane) dihydrate or 2,2'-azobis(2-methoxycarbonylpropane). Based on the monomer quantity of components A+B+C, 0.01 to 2% by weight, preferably 0.1 to 1 % by weight, of initiator is used. It is advantageous to carry out the copolymerization in the absence of oxygen. This can be accomplished in a conventional manner by purging with an inert gas, for example nitrogen. Components A, B, C, which may each consist of one or more individual components, are used in such amounts that the readyprepared polymer preferably contains at least 40 mol %, very particularly preferably at least 80 mol %, of units of a compound of the formula I in copolymerized form, the molar ratio A:B:C preferably being 1:(0 to 4.5):(0 to 0.5), in particular 1:(0.02 to 2.5):0.

The homo- or copolymerization is complete after about 30 minutes to about 4 hours, in many cases after 30 minutes to 2½ hours.

Of the water-soluble copolymers, those are preferred where the preparation involved an amide component B consisting of or containing a basic component $B^1$ of the formula IV, in particular if after the copolymerization these copolymers have been subjected to an additional crosslinking reaction. Preferred basic components $B^1$ here are the compounds of the formulae IIIa to IIId.

To carry out the crosslinking reaction, the solution obtained in the copolymerization is reacted in the presence of water with a polyfunctional alkylating component D and preferably also with a polyamine component E. This polyamine component E can consist of a polyamine component $E^1$ or $E^2$ or of a mixture thereof. If a polyamine component E is used in the crosslinking, it is added to the aqueous solution of the copolymer to be crosslinked before the polyfunctional alkylating component D. Based on 1 mole of basic component $B^1$ present as copolymerized units in the uncrosslinked copolymer, the molar ratio $B^1$:D:E in the crosslinking reaction is 1:(0.002 to 2):(0 to 5), preferably 1:(0.002 to 1):(0.05 to 5), particularly preferably 1:(0.01 to 1):(0.1 to 4.5). The crosslinking is carried out at temperatures of 30° to 90° C., preferably of 40° to 60° C., and is terminated within a few minutes, for example 5 to 20 minutes, preferably 5 to 10 minutes, by the addition of a mineral acid, for example hydrochloric acid, sulfuric acid, phosphoric acid or nitric acid. This addition of mineral acid serves to adjust the pH to 4–7.

The solutions of uncrosslinked or crosslinked homo- or copolymer obtained in the course of the preparation have an active ingredient content of about 15–55% by weight, and can be used in the process according to the invention directly in this form, but preferably after dilution to an active ingredient content of about 25–35% by weight. Frequently, however, the pH is adjusted to 3 –8.5, preferably 7–8, prior to use. This pH adjustment is normally carried out with a strong acid, for example hydrochloric acid, sulfuric acid, phosphoric acid or nitric acid.

The solutions of crosslinked or uncrosslinked homo- or copolymers obtained in the course of the preparation can be dissolved in water either genuinely or at least colloidally.

The amount of polymer used in the process according to the invention is 0.5–10%, on weight of fiber, preferably 3–8 %. To retain the cationic character of this pretreatment agent, the liquor must be set to an acid pH, for example pH 3–6. Preferably, the liquor pH is set to pH 5 by the addition of acetic acid. The pretreatment with the cationic polymer takes place at 50° to 80° C. in the course of about 5 to 20 minutes.

After this pretreatment, the textile material is rinsed with cold water and exhaust dyed with a liquor which contains a pigment dye and a leveling or dispersing agent with or without a salt such as, for example, sodium chloride or magnesium sulfate. Suitable pigment dyes are all the customary pigment types, for example azo, phthalocyanine or quinacridone pigments. These pigments are on the market as aqueous dispersions containing dispersing agents, and are also used in this commercial form in the process according to the invention. The amount of pigment dye can be chosen in such a way as to obtain 0.1–6% dyeings, in individual cases, for example if luminescent pigments are used, even up to 15% strength dyeings (see Example 2).

Besides pigment dye and perhaps a salt, the dyeing liquor always contains a leveling or dispersing agent. Suitable for this purpose are all products customary for this purpose in dyeing; specific examples are the commercial products Eganal® PS, Solidegal® GL or Dispersogen® ASN. These assistants, which prevent speckiness of the dyeing, are added to the liquor in an amount of about 1–8, preferably 3–4%, on weight of fiber.

This pigment dyeing liquor is applied to the textile material by an exhaust method on customary machinery for this purpose, for example a jet, a jigger, a drum washer or a reel beck. The dyeing time is approximately 5 to 20 minutes, and the dyeing temperature is 30° to 90° C., preferably 70° C.

After the dyeing has ended, the ionic strength of the dyeing liquor may be raised by adding a salt in amounts of 1 to 5% by weight, preferably 3% by weight, on weight of fiber. In this case the textile material is subsequently agitated in the dye liquor for a further 10 minutes or so. Preference is given to using sodium chloride, sodium sulfate, ammonium sulfate, ammonium chloride or alum. These salts improve the affinity of the pigment dye for the fiber and also improve the levelness. After the dyeing process has ended, the textile material is rinsed with cold water and dried.

To obtain optimal fastness of the pigment dye on the fiber, the dyeing process may be followed by application of pigment binder to the textile material. Suitable for this purpose are the customary pigment binders, for example the commercial products Imperon® binder CFN or Imperon® binder MTB. These binders are applied in a conventional manner, again by an exhaust method, at 20° to 60° C., preferably at 40° C., in the course of 5 to 20, preferably 7 to 15, minutes. The liquor is adjusted with an acid to a pH of 3 to 6. The amount of pigment binder is approximately 1 to 10% by weight, on weight of fiber. The binder is then crosslinked in a subsequent hot air treatment at 100° to 200° C., preferably at 140° to 170° C., in the course of 10 minutes, preferably 5 minutes. Special effects can be obtained by washing the textile material with a surfactant with or without the addition of sodium carbonate between the actual dyeing and the application of the binder. This intermediate wash, which is carried out in a temperature of 40° to 60° C., takes about 5 to 10 minutes and produces a wash-out effect on the textile material. But even without this intermediate wash the process according to the invention makes it possible, in particular on ready-made goods, for example jeans articles, to obtain stone-wash effects. These effects are normally only obtainable in a time-intensive additional operation, namely with the use of stones and further chemicals, which, however, have an adverse effect on the quality of the cotton. It follows that the process according to the invention has the key advantage that it is now possible to dye with pigment dyes even by the very flexible exhaust methods.

EXAMPLE 1

A pair of cotton jeans is pretreated in an industrial drum washer at a liquor ratio of 30:1 at 70° C. for 10 with a liquor which contains 2% of a modified fatty acid amide (Humectol ® C). This serves to wet out the jeans thoroughly and at the same time to clear them. Since the wetting agent has lubricating properties, the mechanical stress is also reduced.

After this treatment, the liquor is dropped and the jeans are thoroughly rinsed with cold water.

They are then cationized in a fresh bath at 70° C. in the course of 10 minutes with an aqeuous liquor containing 5% of the copolymer of Example 5 of EP-A-277,580 and 2% of 60% strength acetic acid.

After a cold rinse, the jeans are again treated in a fresh bath with an aqueous liquor containing 5% of pigment violet 23 (C.I. 51319)

3% of dispersant (heterocyclic, nitrogen-containing compound or ethoxylated higher alcohol)

at 70° C. for 10 minutes. Then

3% of sodium chloride or sodium sulfate is added. After a further 10 minutes, the dyeing process is ended with a cold rinse.

After drying, the jeans have a strongly colored, somewhat mottled appearance reminiscent of stone washing. The fastness properties are comparable to those of indigo jeans.

EXAMPLE 2

A plain-woven cotton jacket is pretreated as described in Example 1 and then dyed with 15% of Imperon ® Luminescent Orange GR.

The jacket is then treated, to obtain optimal fastness properties, in a liquor which contains 5% of acrylate binder (Imperon ® binder CFN)

1% of 60% strength acetic acid and

3% of dispersant (dimethylpyridinebetaine).

The treatment is carried out at 40° C. for 10 minutes. Thereafter the jacket is whizzed without rinsing and treated at 150° C. with hot air for 5 minutes. The use of a softener in the treatment bath additionally improves the fabric hand properties of the jacket.

EXAMPLE 3

A pair of cotton jeans is pretreated as described in Example 1 and then dyed with 5% of pigment blue 15:1 (C.I. 74160). It It is then washed at 40° C. in a liquor which contains 1 g/l of surfactant (alkylphenyl polyglycol ether) and 2 g/l of sodium carbonate for 10–15 minutes, and rinsed with cold water.

The dyeing process is ended with the acrylate binder treatment described in Example 2 and drying at elevated temperature.

The dyeing obtained has a fashionable washed-out look.

EXAMPLE 4

A viscose/silk blend fabric is wetted out on a jet dyeing machine at a liquor ratio of 20:1 as described in Example 1, thoroughly rinsed with cold water and treated with a liquor containing 5 % of a copolymer of Example 5 of EP-A-277,580.

It is then dyed in a fresh bath with

2% of pigment orange 43 (C.I. 71105)

1% of pigment yellow 83 (C.I. 21108) as described in Example 1.

To obtain good end-use fastness properties, the blend fabric is subsequently fixed with an acrylate binder at pH 5 as described in Example 2. The result is an orange dyeing having a washed-out look.

EXAMPLE 5

A thoroughly pretreated cotton fabric is cold-padded on a padding machine with a liquor containing 50–100 g/l of the copolymer of Example 4 of EP-A-277,580 and 2 gl of 60% strength acetic acid to a wet pickup of 60–80% and dried at 80°–120° C. It is then cross-dyed with pigment dyes by exhaust dyeing on a reel beck as described in Example 1.

What is claimed is:

1. A process for coloring textile material with pigment colorants, which comprises a. pretreating the textile material with a polymer which consists wholly or partly of nonomeric units of the formula I

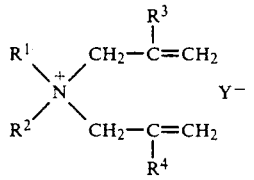

(I)

where $R^1$ and $R^2$ are each hydrogen, $(C_1-C_{22})$alkyl which may be interrrupted by —CO—NH— or $C_1-C_4$-hydroxyalkyl, $R^3$ and $R^4$ are each hydrogen or methyl, and $Y^-$ is a monovalent anion or one equivalent of a polyvalent anion, b. then coloring with a pigment colorant in the presence of a leveling or dispersing agent by the exhaust method and optionally, c. treating in a liquor with a pigment binder and subsequently fixing it.

2. The process as claimed in claim 1, wherein the polymer used consists of monomeric units of the formula I in which $R^1$ and $R^2$ are each $(C_1-C_{10})$alkyl.

3. The process as claimed in claim 1, wherein the polymer used contains monomeric units of the formula I where $R^1$ and $R^2$ are each methyl, $R^3$ and $R^4$ are each hydrogen and $Y^{31}$ is a halogen anion, in copolymerized form.

4. The process as claimed in claim 1, wherein the polymer used is preparable by copolymerizing (a) a diallylammonium component A of the formula I and (b) an amide component B which consists of a basic component $B^1$ of the formula VII

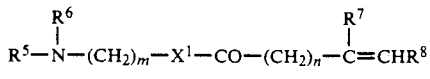

(VII)

and/or amides of the general formula VIII

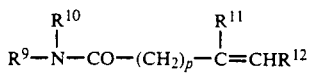

(VIII)

and/or N-vinylacylamides of the general formula IX $$CH_2{=}CH{-}\overset{\overset{\displaystyle R^{13}}{|}}{N}{-}CO{-}R^{14} \quad \text{(IX)}$$

and/or ammonium compounds of the general formula X $$R^{16}{-}\overset{\overset{\displaystyle R^{15}}{|}}{\underset{\underset{\displaystyle R^{17}}{|}}{N}}{-}(CH_2)_q{-}X^2{-}CO{-}(CH_2)_r{-}\overset{\overset{\displaystyle R^{18}}{|}}{C}{=}CHR^{19}\,\overset{+}{Z}^{-} \quad \text{(X)}$$

and (c) a (meth)acrylic ester component C of the formula XI $$CH_2{=}\overset{\overset{\displaystyle R^{20}}{|}}{C}{-}COOR^{21} \quad \text{(XI)}$$

in a molar ratio of A:B:C=1:(0 to 4.5):(0 to 0.5), and, if a component $B^1$ is present, subsequently crosslinking with (d) a polyfunctional alkylating component D and (e) a polyamine component E which consists of a polyamine component $E^1$ of the formula XII $$H_2N{-}(CH_2)_s{+}NH{-}(CH_2)_s{-}\underset{\underset{\displaystyle T}{|}}{N}{-}(CH_2)_s{+}_t NH_2 \quad \text{(XII)}$$

and/or a polyamine component $E^2$ of the formula XIII $$HOOC{-}R^{22}{-}CO{-}NH{-}(CH_2)_u{-}NH{+}(CH_2)_u{-}NH{+}_w R^{23} \quad \text{(XIII)}$$

in a molar ratio of $B^1$:E:D=1:(0 to 5):)0.002 to 2), wherein $R^5$, $R^6$, $R^{21}$=($C_1$-$C_{10}$)alkyl, $R^7$, $R^8$, $R^{11}$, $R^{12}$, $R^{18}$, $R^{19}$, $R^{20}$=hydrogen or methyl, $R^9$, $R^{10}$, $R^{13}$=hydrogen or ($C_1$-$C_8$)alkyl, $R^{14}$, $R^{15}$, $R^{16}$, $R^{17}$=($C_1$-$C_8$)alkyl or $R^{13}$ and $R^{14}$ together=—$(CH_2)_3$—, —$(CH_2)_4$)— or —$(CH_2)_5$, $R^{22}$ is an alkylene radical of 1 to 8 carbon atoms or phenylene, $R^{23}$ is hydrogen or the radical —CO—$R^{22}$—COOH, $X^1$, $X^2$=—NH— or —O—, $Z^-$is a monovalent anion or one equivalent of a polyvalent anion, T =—[—$(CH_2)_s$—NH—]$_v$—H m, q=one of the numbers 2, 3, 4, 5, 6, 7, 8, 9, 10 n, p, r, w=one of the numbers 0, 1, 2 or 3, s, u=one of the numbers 2,3,4 or 5, v=the number 0 or such a number that the polyamine component $E^1$ has a molecular weight of 1000 to 30,000 if t is taken into account, t=such a number that, if v is taken into account, the molecular weight of the polyamine component $E^1$ of the formula VII is between 1000 and 30,000.

5. The process as claimed in claim 4, wherein the polymer used has $R^5$, $R^6$, $R^{14}$, $R^{15}$, $R^{16}$ and/or $R^{17}$=($C_1$-$C_4$)alkyl and/or $R^9$, $R^{10}$ and/or $R^{13}$=hydrogen or ($C_1$-$C_4$)alkyl and/or n, p and/or v =0.

6. The process as claimed in claim 1, wherein the polymer used contains 15 to 100 mol %, of monomeric units of the formula I.

7. The process as claimed in claim 1, wherein said textile material is first pretreated with a wetting agent.

8. The process as claimed in claim 1, wherein ready-made garments are colored.

9. The process as claimed in claim 1, wherein the textile material is washed after coloring and before the pigment binder is applied.

10. The process as claimed in claim 1, wherein, after the coloring has ended, salt is added to the dyeing liquor and left to reside therein.

11. The process as claimed in claim 1, wherein the polymer used consists of nonomeric units of the formula I in which $R^1$ and $R^2$ are each ($C_1$-$C_4$)alkyl.

12. The process as claimed in claim 1, wherein $Y^-$is chloride anion.

13. The process as claimed in claim 4, wherein said molar ratio of A:B:C is 1:(0.002 to 4.5):(0 to 0.5).

14. The process as claimed in claim 1, wherein the polymer used contains 80 to 100 mol % of monomeric units of the formula I.

* * * * *